US005662338A

United States Patent [19]

Steinhauser, Jr.

[11] Patent Number: 5,662,338

[45] Date of Patent: Sep. 2, 1997

[54] SKATE WITH LATERAL TORQUE SUPPORT MEMBERS

[75] Inventor: Paul M. Steinhauser, Jr., Davison, Mich.

[73] Assignee: Victor Posa, Grand Blanc, Mich.

[21] Appl. No.: 388,980

[22] Filed: Feb. 15, 1995

[51] Int. Cl.[6] ..... A63C 1/16; A63C 17/18

[52] U.S. Cl. ..... 280/7.14; 280/11.27; 280/11.3

[58] Field of Search ..... 280/7.12, 7.13, 280/7.14, 11.19, 11.27, 11.3, 11.31, 11.32, 11.33, 11.34

[56] References Cited

U.S. PATENT DOCUMENTS

| | | | |
|---|---|---|---|
| 2,244,719 | 6/1941 | Mansfield | 280/11.3 |
| 2,868,553 | 1/1959 | Rieckman | 280/11.27 |
| 2,998,260 | 8/1961 | Meyer | 280/7.13 |
| 3,043,600 | 7/1962 | Voakes | 280/7.13 |
| 3,292,940 | 12/1966 | Weitzner | 280/7.13 |
| 3,526,976 | 9/1970 | Jacobs | 280/7.13 |
| 3,918,729 | 11/1975 | Peters | 280/11.3 |
| 4,008,901 | 2/1977 | Conn | 280/7.13 |
| 4,114,295 | 9/1978 | Schaefer | 36/100 |
| 4,150,499 | 4/1979 | Wang | 36/115 |
| 4,328,627 | 5/1982 | Sanders | 36/115 |
| 4,657,265 | 4/1987 | Ruth | 280/7.13 |
| 4,932,675 | 6/1990 | Olson et al. | 280/7.13 |
| 4,988,122 | 1/1991 | Saunders | 280/11.19 |
| 5,046,746 | 9/1991 | Gierveld | 280/11.27 |
| 5,193,827 | 3/1993 | Olson | 280/7.13 |
| 5,314,199 | 5/1994 | Olson et al. | 280/7.13 |
| 5,524,912 | 6/1996 | Laub et al. | 280/7.13 |
| 5,549,310 | 8/1996 | Meibock et al. | 280/11.27 |

*Primary Examiner*—Brian L. Johnson
*Assistant Examiner*—Frank Vanaman
*Attorney, Agent, or Firm*—Young & Basile, PC

[57] ABSTRACT

A skate includes a shoe body and an attachment supporting a use element affixed to the sole of the shoe body by fasteners. Lateral support ribs formed on one of the attachment and the sole engage complimentary shaped apertures formed in the other of the attachment and the sole to isolate lateral torque forces from the fasteners. In a convertible skate, the lateral support ribs and the engaging apertures are formed in an adapter plate attached to the shoe body and an attachment plate forming a part of an attachment which is releasably mounted in the adapter plate. A plurality of distinct attachments, each having a different use, may be interchangeable mounted in the adapter plate and provide it with the lateral support ribs or engaging apertures.

17 Claims, 7 Drawing Sheets

SKATE WITH LATERAL TORQUE SUPPORT MEMBERS

BACKGROUND OF THE INVENTION

1. Field of the Invention

The present invention relates, in general, to skates.

2. Description of the Art

Ice skates, roller skates and, more recently, in-line roller skates have been used by many for enjoyment as well as to play various sports, such as hockey. The recently popular in-line roller skates have also been used by serious hockey players for off season training as well as to play hockey using on a non-ice surface.

In all types of skates, the ice blades, the toe and heel roller skate assemblies, and the in-line assembly containing a plurality of urethane rollers are securely and generally permanently attached to the sole of a skate boot or shoe. This has resulted in the dedicated use of hockey skates, roller skates or in-line roller skates for a single activity or sport.

The advantages of providing such skates with easily attachable and detachable assemblies including ice blades, toe and heel roller assemblies, or an in-line roller assembly, has been noted and a large number of interchangeable or convertible skates have been devised. The use of such convertible skates provides the ability, in the case of ice skates and in-line roller skates, to easily switch between ice hockey and in-line roller skating without the need for and, more importantly, the expense of providing separate skate boots or shoes which represent a major part of the cost of a pair of ice skates or in-line roller skates. Thus, for example, a hockey player using a convertible skate could use the same pair of boots or shoes with ice blades to play ice hockey and then, with the removal of the ice blades and the attachment of an in-line roller assemblies to the same boot or shoe, to be able to use such in-line skates for exercise, enjoyment or to play hockey on a non-ice surface.

Such convertible skates also provide the user with an opportunity to have a second replacement set of ice blades, in-line roller assemblies, etc., for immediate use in the case of damage or dulling of the pair of blades or roller assemblies attached to the user's skate boots.

Although numerous convertible or replaceable skates have been previously proposed, the skate art still lacks a commercially viable convertible skate which meets the primary criteria of ease of attaching and detaching the blades or in-line roller assemblies to the skate boot and, more importantly, providing a rigid, secure attachment of the blade and roller assembly to the boot which does not exhibit any play or relative movement between the blade or roller assembly and the boot especially under the high forces imposed on the skate devices starting and stopping movements.

In conventional ice skates, in-line roller skates and even with certain types of convertible skates, fasteners, such as rivets, are commonly used to attach the ice blade, in-line rollers, etc., to the shoe sole. During use, and particularly during quick starts and stops, high lateral torque forces are exerted on the rivets which frequently results in damage or breakage of the rivets. This requires frequent replacement of the rivets or fasteners which at best is a time consuming process and renders the skate inoperative for the length of the repair process.

Thus, it would be desirable to provide lateral support means for use in a conventional ice skate, in-line skate, as well as a convertible skate receiving interchangeable use attachments which minimizes the effect of high lateral torque forces on the fasteners used to attach the blades or rollers to the skate shoe. It would also be desirable to provide such lateral support members on a skate in a manner in which the lateral support members do not interfere with the use or mounting of the blades or rollers to the skate shoe. It would also be desirable to provide a convertible skate in which use attachments are securely attached to the shoe body without any relative movement in either longitudinal or lateral directions, with respect to the shoe body.

SUMMARY OF THE INVENTION

In one embodiment, the present invention is a convertible skate which is capable of interchangeably receiving various attachments, each capable of a different use.

According to this embodiment of the present invention, a convertible skate includes a shoe body and an adapter plate fixedly connected to or integrally formed with the shoe body. The adapter plate has a central portion and a peripheral lip depending from the central portion away from the shoe body. An attachment is releasably mountable in the adapter plate. Means are provided for releasably connecting the attachment to the adapter plate.

Preferably, the attachment comprises one of a plurality of distinct attachments, each capable of a different use, which are interchangeably mountable in the adapter plate.

Each attachment includes an attachment plate which has one of an ice skate blade, in-line roller assembly, shoe sole, snow shoe, ice claws, etc., attached thereto. The attachment plate is shaped to fit in registry with the central portion and the peripheral lip of the adapter plate.

The means for connecting the attachment to the adapter plate preferably comprises fastener means carried by the adapter plate which are releasably engagable with the attachment plate. Preferably, the fastener receiving means comprise a plurality of inserts or nuts having an internally threaded bore. The fastener receiving means are preferably fixedly mounted between the adapter plate and the shoe sole. In a preferred embodiment, when the adapter plate is integrally formed as a unitary molded piece with the shoe, the fastener receiving means is molded within the attachment plate. A depending clip may also be mounted in and extending below one end of the adapter plate for fixedly engaging a forward edge of the attachment plate.

Each fastener preferably includes an intermediate frustoconical surface which engages a conically shaped bore formed within the attachment plate to minimize lateral and longitudinal movement of the attachment plate relative to the adapter plate. Further, the fasteners carry a user engagable member, such as a disk having a serrated edge which permits manual tightening and loosening of the fasteners during attachment and detachment of the attachment plate with respect to the adapter plate. This eliminates the need for a separate tool to releasably mount the various attachments in the adapter plate. Alternately, a nut may be mounted on the exterior end of the fastener for receiving a suitable tool, such as a wrench, for further tightening of the fasteners if desired.

The plurality of attachments include an ice skate blade mounted in a support or housing which is fixedly connected to the attachment plate. Alternately, the attachment includes an in-line roller assembly including a plurality of in-line arranged rollers mounted in a support which is fixedly attached to the attachment plate. Further, the attachment may be a shoe sole which is fixedly attached to the attachment plate. Additional attachments may also include a speed skate blade, a figure skate blade, a snow ski, snow shoe, ice claw, etc.

In one embodiment, a sole is attached to the shoe body, with the adapter plate being fixedly connected to the sole. The sole may be formed as an integral molded part of the shoe body. In another embodiment, the adapter plate is integrally molded as a unitary part of the sole of the shoe body or as the sole of the shoe body. In this embodiment, the connecting means comprises a plurality of inserts mounted in the adapter plate, each insert having an internal, threaded bore. A plurality of fasteners are extendible through the apertures in the attachment plate into the inserts to fixedly connect the attachment plate to the adapter plate.

In another embodiment, a lateral support means is mounted on one of the shoe sole and the attachment carrying a use element for laterally supporting the attachment and the use element against lateral use forces. Support engaging means are mounted on the other of the shoe sole and the attachment for securely receiving the support means to minimize lateral movement of the attachment and use element relative to the shoe body.

Preferably, the support means is in the form of at least one projection or rib formed on one of the attachment and the shoe sole which engages a complimentarily formed aperture, such as a slot, in the other of the attachment and the shoe sole when the attachment is affixed to the shoe sole. Even more preferably, the support means is in the form of two spaced pairs of elongated projections or ribs, each pair disposed on opposite sides of the longitudinal center line of the use element. In the specific case of an ice skate or an in-line roller skate, one pair of ribs is disposed at the toe section of the skate; while the other pair of ribs is disposed at the heel section of the skate.

In the case of a convertible skate of the present invention, the pairs of ribs may be formed on either of the adapter plate or the attachment plate, with the complementarily formed apertures or slots formed in the opposed adapter plate or attachment plate. In this manner, the ribs snugly engage the apertures or slots when the attachment plate is mounted in the adapter plate. In the convertible skate of the present invention, the lateral support ribs cooperate with the depending lip on the adapter plate to further secure the attachment against lateral movement and to minimize the effects of high lateral torque forces exerted through the attachment to the fastener(s) used to connect the attachment and adapter plates together.

The lateral support members of the present invention provide a unique solution to the problem caused by high lateral torque forces exerted in the fasteners used to mount various use attachments, such as ice skates, in-line rollers, etc., to a skate shoe body. The additional support provide by the interlocking support ribs and complimentary shaped apertures isolates such lateral forces from the fasteners thereby prolonging the useful life of the fasteners and minimizing any necessary repairs caused by the effects of such lateral torque forces on the fasteners as occurs in conventional ice skates, in-line roller skates, etc.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENTS

Figure 18:
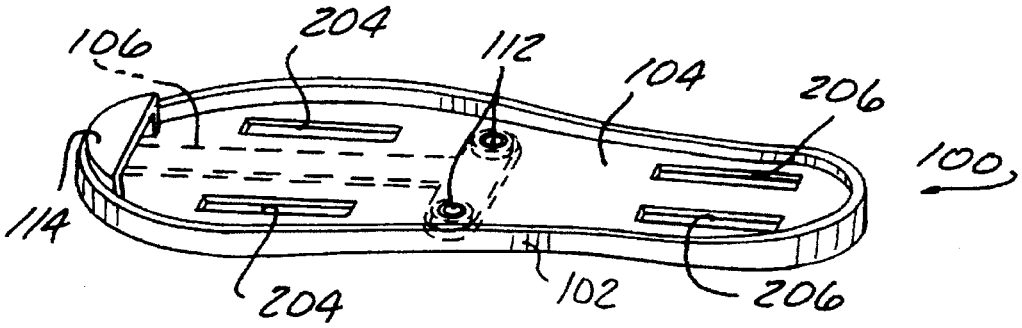
FIG. 18 is a bottom perspective view, similar to FIG. 11, but showing the position of the support rib receiving apertures in the adapter plate.

Referring now to the drawings and to FIGS. 18, there is depicted several embodiments of a convertible skate denoted generally by reference number 10 which enables a single skate boot or shoe body to interchangeably receive one of a plurality of different attachments, such as an ice blade, an in-line roller assembly, a shoe sole, etc.

Figure 1:
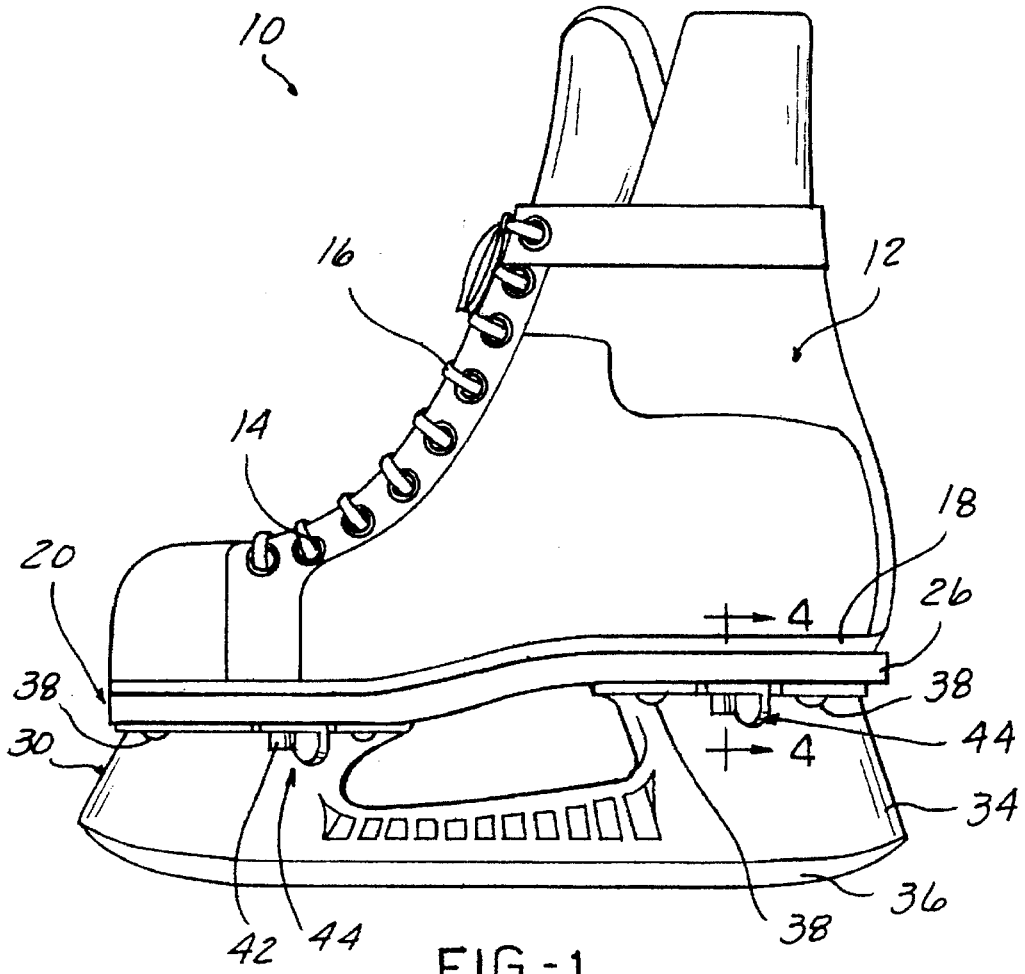
FIG. 1 is a side elevational view of a convertible skate constructed in accordance with the one embodiment of the present invention and shown as having an ice blade assembly mounted thereon.

As shown in FIG. 1, the skate 10 includes a shoe body 12 of conventional construction. The shoe body 12 may be formed of any suitable shoe material, such as leather, rigid or soft plastic, or combinations thereof. A plurality of apertures 14 are provided on the shoe body 12 for receiving conventional laces 16. Other shoe securing means, such as clasps, etc., may also be employed on the shoe body 12.

In the embodiment shown in FIG. 1, the shoe body 12 has a sole 18 integrally formed therewith or attached to a bottom portion of the shoe body 12 in a conventional manner. The sole 18 may be formed of any suitable material, such as leather, plastic, etc.

Figure 2:
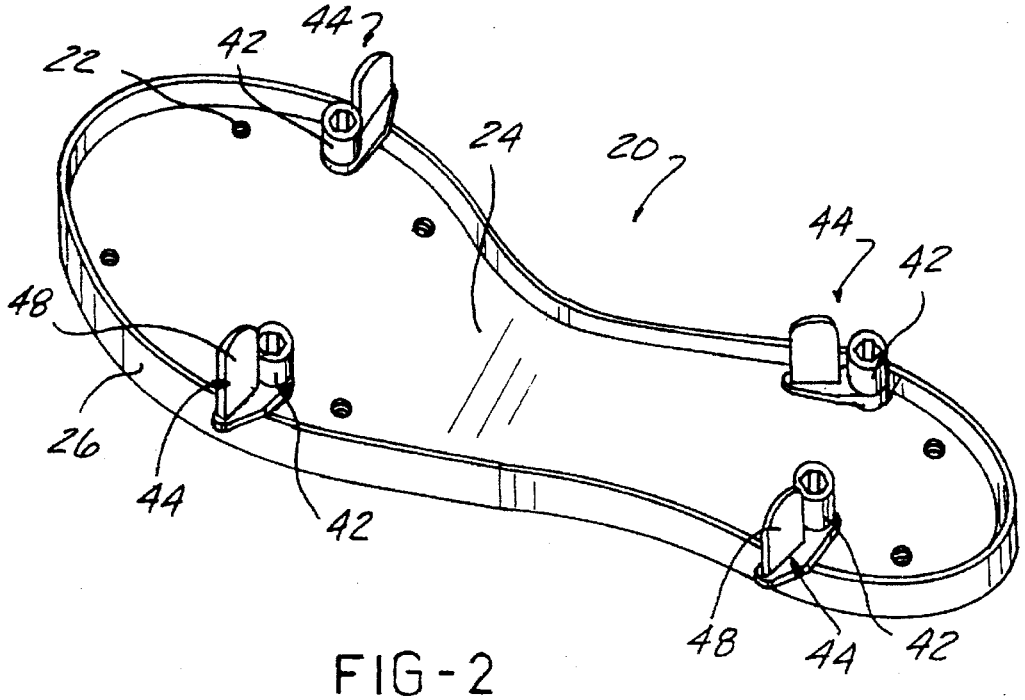
FIG. 2 is a bottom perspective view of the adapter plate of the convertible skate shown in FIG. 1.

According to the present invention, the convertible skate 10 includes an adapter means 20 generally in the form of a plate which is shown in greater detail in FIG. 2. The adapter means, hereafter referred to simply as the adapter plate 20, may be formed of any suitable material, such as metal, plastic, etc. However, plastic is preferred due to its light weight. Although the adapter plate 20 may have a generally planar form from a toe end to a heel end, preferably, the toe and heel ends are vertically offset, as shown in FIG. 1, as found in a normal shoe or boot. The adapter plate 20 is secured to the sole 18 of the shoe body 12 by means of suitable fastening means which may include the use of adhesives as well as various fasteners, such as screws, rivets, etc., which extend through apertures 22 formed in the adapter plate 20 into the sole 18.

Figure 4:
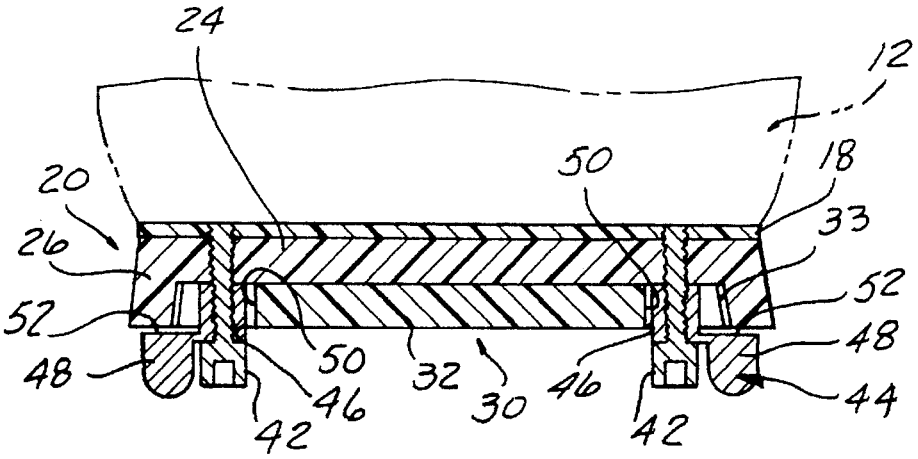
FIG. 4 is a cross-sectional view generally taken along line 4—4 in FIG. 1.

Generally, the adapter plate 20 includes a central portion 24 which has an exterior shape matching that of the sole 18. A sidewall 26 depends from the central portion 24 and forms a recessed cavity between the interior confines of the peripheral sidewall 26 and the central portion 24. The peripheral sidewall 26 is preferably disposed at an obtuse angle so as to extend angularly outwardly from normal to the plane of the central portion 18 as shown in FIG. 4. By way of example only, the peripheral sidewall 26 is disposed at a 1°–3° angle from normal to the central portion 24.

Figure 3:
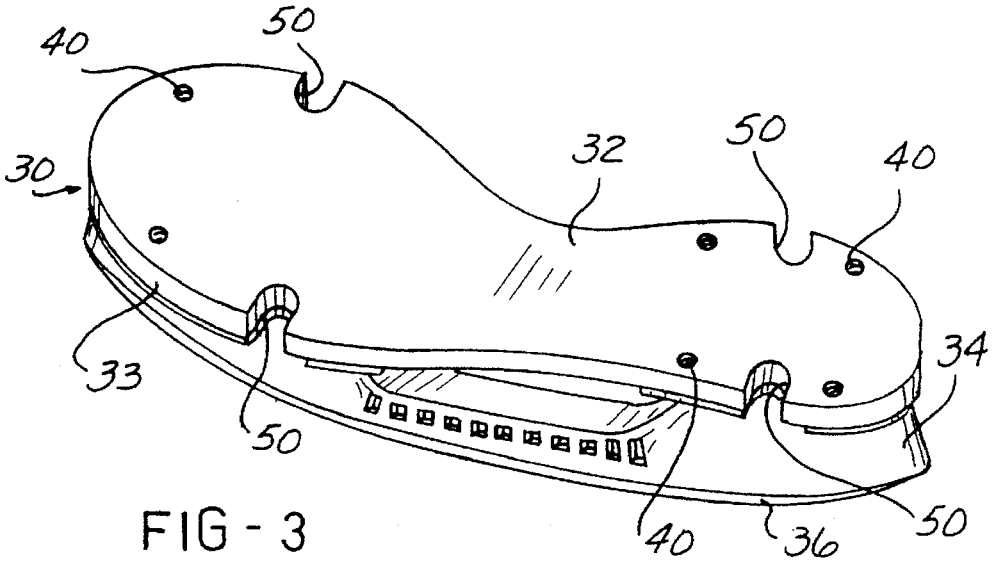
FIG. 3 is a perspective view of the ice blade assembly attachment shown in FIG. 1.
Figure 5:
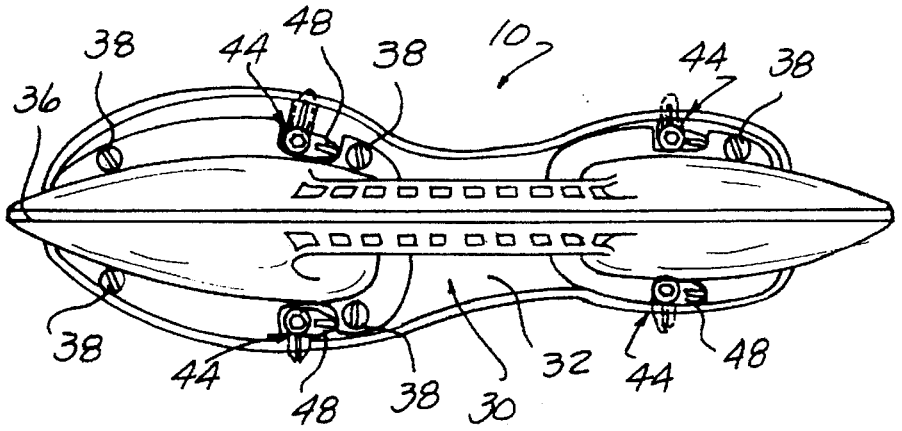
FIG. 5 is a bottom plan view of the ice blade embodiment of the convertible skate shown in FIG. 1.

An attachment denoted generally by reference number 30, as shown in FIG. 1 and in greater detail in FIGS. 3, 4 and 5, is detachably mountable in the adapter plate 20. Preferably, the attachment 30 is one of a plurality of distinct attachments, others of which are described in greater detail hereafter.

The attachment 30 includes an attachment plate 32 which has an overall size and shape so as to fit in substantial registry in the internal recess in the adapter plate 20 in tight, non-movable engagement with the central portion 24 and the sidewall 26 of the adapter plate 20. The peripheral edge 33 of the attachment plate 32 is formed at an angle with respect to the plane of the attachment plate 32 which is complimentary to the obtuse angle of the peripheral sidewall 26 of the adapter plate 20, i.e. 1°–3° in the noted example. A support or housing 34, which carries an ice blade 36 in the embodiment shown in FIGS. 1, 3 and 5 is mounted on the attachment plate 32. The support 34 is typically formed of a molded plastic, although metal may also be used and is secured at an upper end to the attachment plate 32 by means of fasteners, such as screws 38, which extend through an upper mounting portion of the support 34 through apertures 40 in the attachment plate 32 to securely connect the support 34 and the ice blade 36 to the attachment plate 32.

According to the present invention, means are provided for releasably attaching the attachment plate 32 of the attachment 30 to the adapter plate 20. In one embodiment shown in FIGS. 1–5, the attaching means preferably comprises fastener means 42 depending from the adapter plate 20. Preferably, the fastener means 42 comprises a threaded Allen head screw which extends through the apertures 40 in the attachment plate 32 as well as through the apertures 22 in the central portion 24 of the adapter plate 20 into the sole 18 of the shoe body 12 to also serve to securely mount the adapter plate 20 to the sole 18 of the shoe body 12. A cam means denoted generally by reference number 44 is movably mounted about the threaded shank of each screw 42. The cam means 44 includes a hollow base 46 rotatably disposed about the shank of the screw 42 and an enlarged wing or pad 48 integrally formed with and extending outward from the base 46. As shown in FIGS. 2 and 4, the pad 48 is disposed adjacent to the head of the fastener 42 and is rotatable thereabout. The screws 42 may be tightened so as to lock the fastener 44 and the pad 48 in a fixed position as described hereafter.

Engagement apertures 50 are formed in the attachment plate 32. The fasteners 42 on the adapter plate 20 extend through the apertures 50 in the attachment plate 32, as shown in FIG. 4, to enable the attachment plate 32 to be mounted on the adapter plate 20.

Four apertures 50, preferably in the form of slots extending from an open end on a peripheral edge 33 of the attachment plate 32, are provided by way of example only. Similarly, four fasteners 42 are mounted on the adapter plate 20.

In use, the screws 42 are loosened and the pads 48 of the fasteners 44 rotated to an outwardly extending position from the longitudinal center line of the adapter plate 20, as shown in phantom in FIG. 5. In this position, the pads 48 are in alignment with the longitudinal open extent of the slots 50 and permit the attachment plate 32 to be inserted into the recess in the adapter plate 20, with the apertures 50 passing over the pads 48 and the heads of the screws 42. The pads 48 are then rotated inward to the position shown in solid in FIG. 5. In this position, an inner surface 52 of the each pad 48 engages the surface of the attachment plate 32 in a camming action to force and retain the attachment plate 32 in secure, non-movable engagement with the adapter plate 20. The screws 42 may then be tightened to lock the pads 48 in a locking position to securely retain the attachment 30 in the adapter plate 20.

The sequence is reversed to release the attachment 30 including the attachment plate 32 from the adapter plate 20.

As shown in FIG. 4, when the attachment plate 32 is mounted in the adapter plate 20, in substantial registry with the central portion 24 of the adapter plate 20, the angularly disposed peripheral edge 33 of the attachment plate 32 engages the angularly disposed inner surface of the depending sidewall 26 of the adapter plate 20 in a tight, non-movable fit. This prevents any movement of the attachment plate 32 relative to the adapter plate 20 in either longitudinal or lateral directions thereby providing a secure, non-movable mounting of the attachment 30 to the adapter plate 20.

Figure 6:
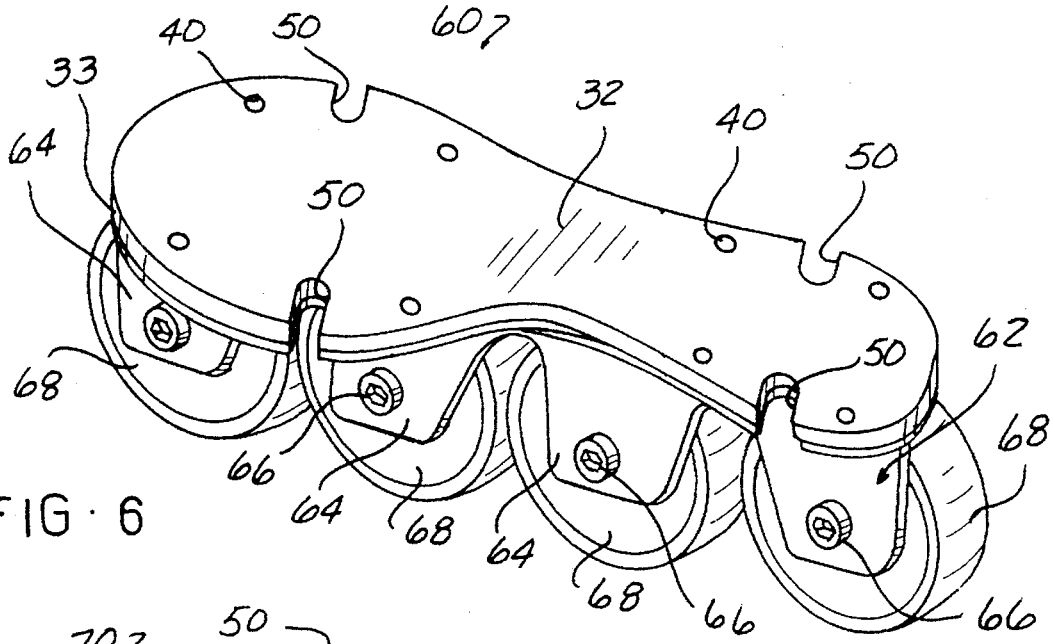
FIG. 6 is a perspective view of an in-line roller assembly attachment usable with the shoe body of the convertible skate shown in FIG. 1.

A different attachment 60, shown in FIG. 6, is also releasably mountable in the adapter plate 20 on the shoe body 12. The attachment 60 includes an in-line roller assembly denoted generally by reference number 62 which is secured at an upper portion to the attachment plate 32 by means of fasteners extending through the apertures: 40 in the attachment plate 32. As shown in FIG. 6, the attachment plate 32 is also provided with a plurality of apertures 50, preferably in the form of open-ended slots extending inward from the peripheral edge 33 of the attachment plate 32.

The in-line roller assembly 62 may be of any conventional construction and includes a plurality of pairs of depending, spaced legs 64, each of which receives an axle 66 therethrough for rotatably mounting a roller 68 thereon. The attachment 60 is detachably mounted in the adapter plate 20 in the same manner as the attachment 30 described above.

It should further be noted that the attachments 30 and 60 are provided with identical heights from a lower ground or ice engaging surface of the blade 36 in the attachment 30 or the rollers 68 in the attachment 60 with respect to the upper surface of the attachment plate 32. In this manner, regardless of which attachment 30 or 60 is mounted on the shoe body 12, the height of the shoe body 12 with respect to an underlying surface is the same.

Figure 7:
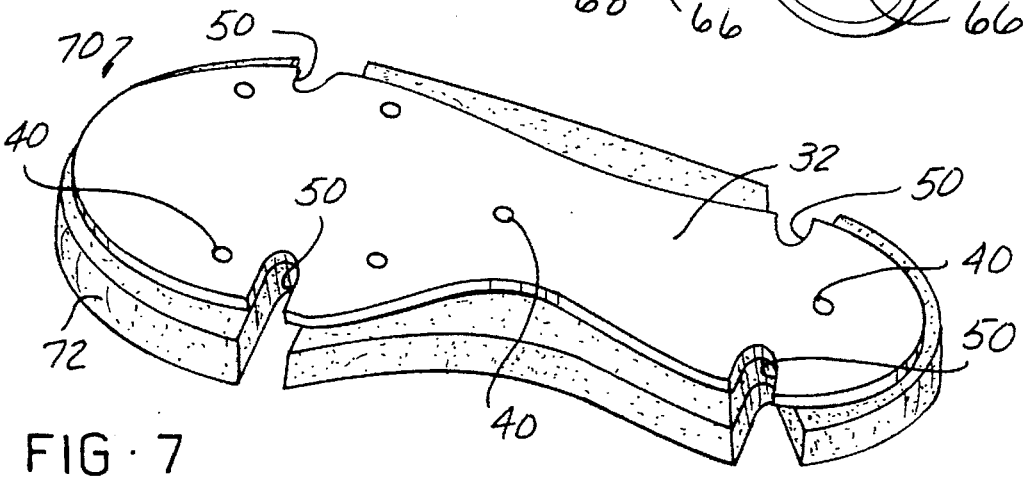
FIG. 7 is a perspective view of a shoe sole attachment usable with the shoe body of the convertible skate shown in FIG. 1.

Yet another attachment 70, shown in FIG. 7, is also releasably mountable in the adapter plate 20 on the shoe body 12. The attachment 70 also includes an attachment plate 32 having a plurality of apertures 50, such as open-ended slots, formed therein.

A conventional shoe sole 72 is attached to the adapter plate 32 in the attachment 70 by means of suitable fasteners extending through the sole 72 through the apertures 40 in the attachment plate 32. The sole 72 may be formed of any suitable material, such as a molded rubber or plastic, by way of example only. It should be noted that in the attachment 70, as well as in the previously described attachments 30 and 60, slots are formed in the sole 72 in line with the slots 50 in the attachment plate 32 to pass over the fasteners 42 on the adapter plate 20 when the attachment plate 32 is inserted in or removed from the adapter plate 20.

Figure 8:
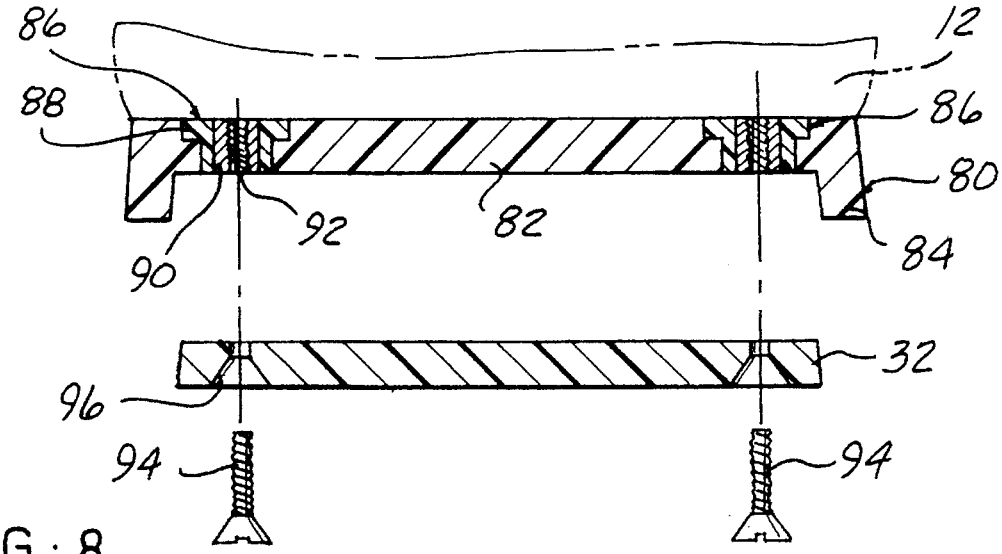
FIG. 8 is a cross-sectional view, generally taken along line 4—4 in FIG. 1, but showing an alternate embodiment of the connecting means used to connect the attachment plate of each of the various attachments to the adapter plate mounted on the shoe body.

Another embodiment of the convertible skate 10 of the present invention is shown in FIG. 8. This embodiment, which is usable with any of the attachments 30, 60 or 70 includes an adapter plate 80 having substantially the same construction as the adapter plate 20 described above and shown in FIGS. 1 and 2. However, in this embodiment, the adapter plate 80 forms the sole of the shoe body 12. Preferably, the adapter plate 80 is formed of a plastic material and is integrally molded as a unitary one-piece part of the shoe body 12. The adapter plate 80 also includes a central portion 82 and a depending peripheral sidewall 84 disposed at an obtuse angle with respect to the central portion 82 as in the adapter plate 20 described above.

In this embodiment, the means for attaching the various attachments to the adapter plate 80 incudes a plurality, such as four by way of example only, of inserts 86 which are located about the periphery of the central portion 82 of the adapter plate 80. The inserts 86 are of conventional construction and are formed of a molded plastic body 88 having a through bore extending therethrough. A metallic sleeve 90 is press fit or otherwise fixedly mounted in the bore of the housing 88. The sleeve 90 has an internally threaded throughbore 92 formed therein.

The sleeves 90 threadingly receive fasteners 94, such as a flat head Allen screw or an Allen head cap screw, which extend through apertures 96 formed in the attachment plate 32 of any of the attachments 30, 60 or 70 described above to releasably mount the attachment plate 32 and the attachment mounted thereon to the adapter plate 80. It will also be understood that the cam-type fastener 44 described above and shown in detail in FIG. 4 can also be employed with the adapter plate 80 shown in FIG. 8.

FIGS. 9–16 depict other embodiments of the present invention. Components shown in FIGS. 9–15 which correspond to like components shown in FIGS. 1–8 are indicated by the same reference number.

Figure 9:
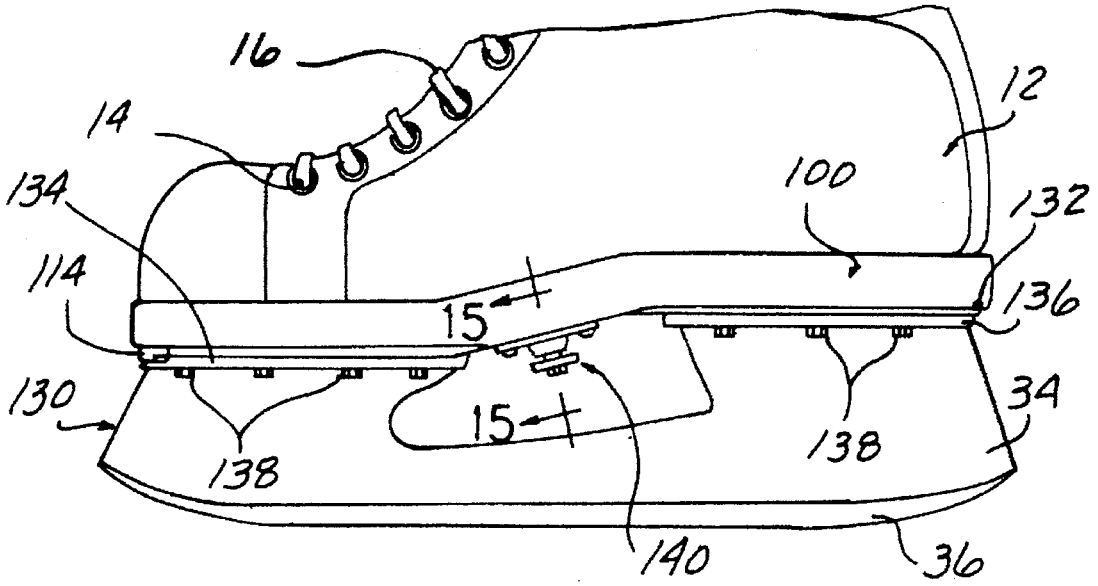
FIG. 9 is a partial side elevational view of another embodiment of the convertible skate of the present invention.
Figure 10:
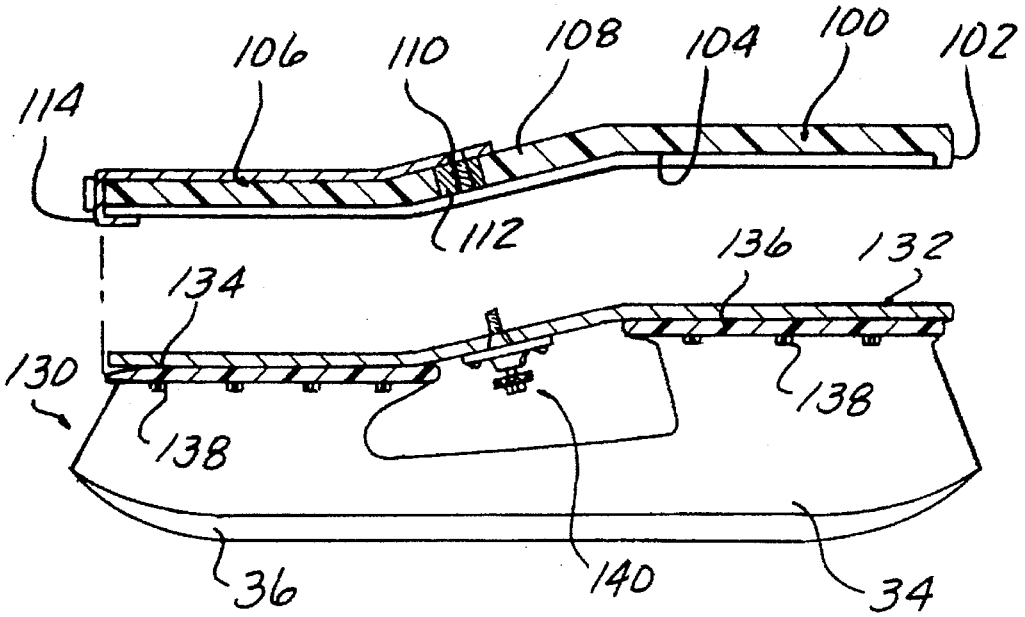
FIG. 10 is partially longitudinal cross sectional, exploded view showing the releasable engagement of the attachment to the adapter plate.

In this embodiment, an adapter plate 100 is integrally formed, such as by unitary molding, with the bottom portion of the shoe to form a one piece member as shown in FIGS. 9 and 10. In such an integral, one piece, molded construction, the adapter plate 100 actually forms the sole of the skate body. Accordingly, the adapter plate 100 is formed of a suitable high strength moldable material, such as plastic. As in the first embodiment, the adapter plate 100 includes a peripheral sidewall 102 depending from a central portion 104.

Figure 11:
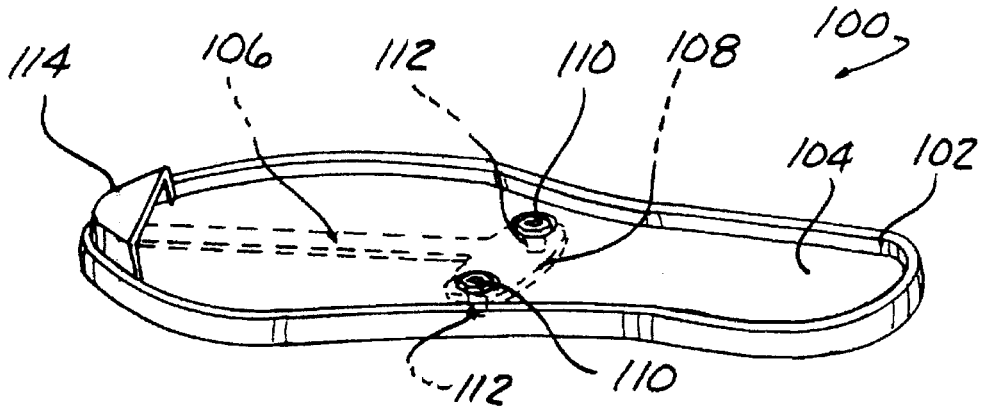
FIG. 11 is a bottom perspective view of one embodiment of the adapter plate shown in FIGS. 9 and 10.

In this embodiment, a backing member 106 is mounted within the adapter plate 100 and forms a portion of a fastener receiving means. The backing member 106 is preferably integrally molded in the adapter plate 100; although fasteners may also be employed for mounting. One embodiment of the backing member 106 is shown in FIGS. 10 and 11. In this embodiment, the backing member 106 is in the form of an elongated metallic strip having an enlarged first end 108 in which a pair of spaced through apertures 110 are formed. A fastener receiving means such as a threaded member 112, i.e. a nut, having an internally threaded bore is fixed, such as by welding, on the enlarged first end 108, with the bore in the nut 112, aligned with the apertures 110 in the backing member 106.

The forward or toe end of the reinforcing member 106 is provided with a cup-shaped member 114 which extends externally of the adapter plate 100 and below the edge of the sidewall 102. The cup-shaped member 114 has a generally semi-circular shape to define a hollow receptacle which engages the toe end of the attachment plate and aids in resulting lateral and longitudinal movement of the attachment relative to the adapter plate 100.

Figure 12:
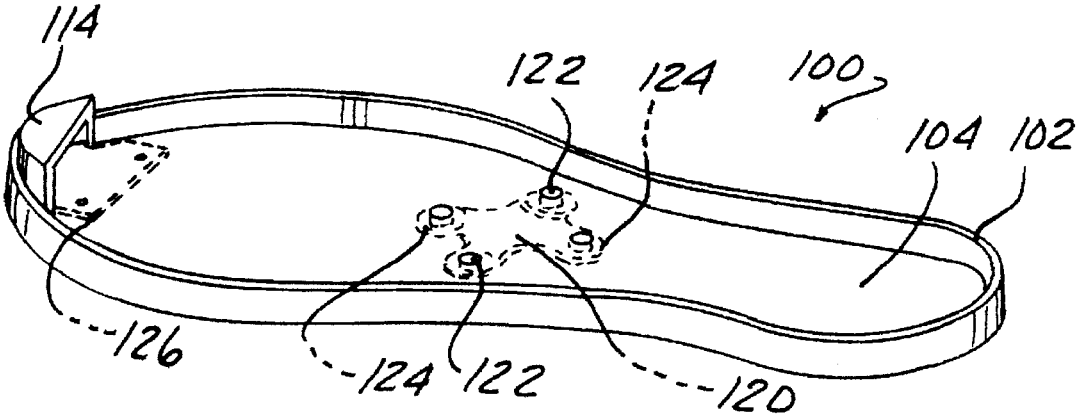
FIG. 12 is a bottom perspective view of another embodiment of the adapter plate.

An alternate embodiment of the backing member is shown in FIG. 12. In this embodiment, a small plate 120 is mounted on the adapter plate 100 by means of fasteners or by integral molding and has a pair of apertures 122 aligned with threaded nuts 112 welded on the plate 120. Intermediate outwardly extending flanges 124 are formed on the plate 120 for receiving mounting fasteners to fixedly attach the plate 120 to the adapter plate 100. In this embodiment, the cup-shaped member 114 is mounted to a separate plate 126 intergrally molded in attached to the adapter plate 100 by means of fasteners.

Figure 13:
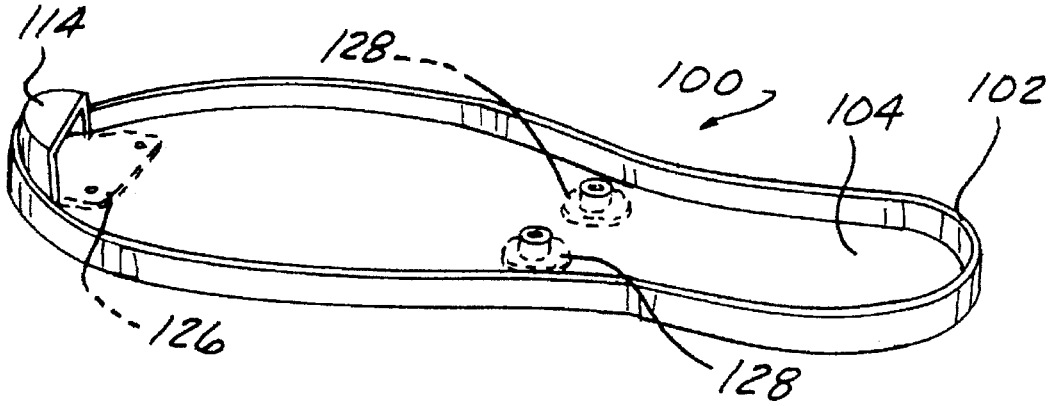
FIG. 13 is a bottom perspective view of yet another embodiment of the adapter plate.
Figure 14:
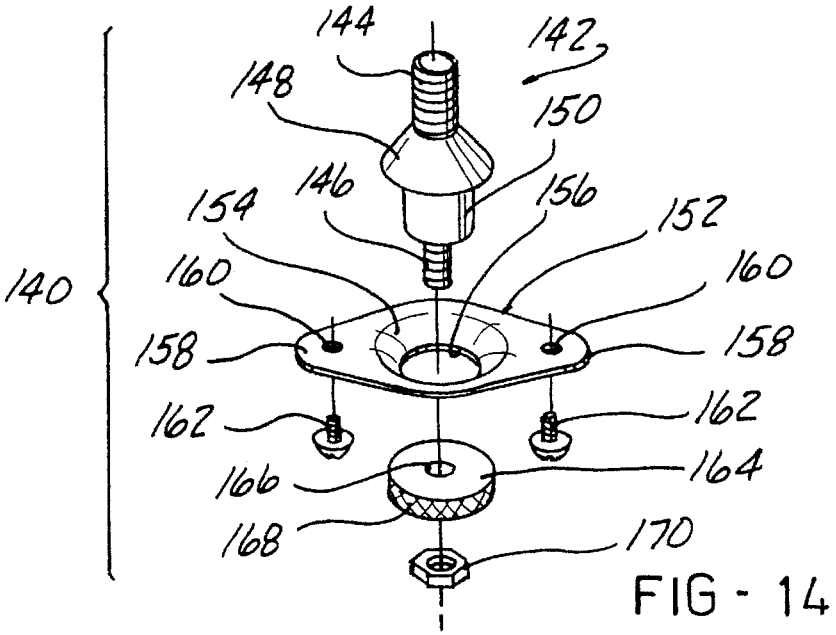
FIG. 14 is an exploded, perspective view of a fastener employed in the convertible skate shown in FIGS. 9 and 10.

Yet another embodiment of the backing member is shown in FIG. 13. In this embodiment, the cup-shaped member 114 is also formed as a part of a separate plate 126 attached to or integrally molded in the toe end of the adapter plate 100. A pair of threaded inserts 128, similar to the inserts 86 described above and shown in FIG. 8, are mounted in or integrally molded in the adapter plate 100, with the threaded bore with the inserts 128 aligned with apertures formed in the adapter plate 100.

Referring again to FIGS. 9 and 10, one embodiment of an attachment 130 is depicted for releasable engagement with the adapter plate 100. In this embodiment, the attachment 130 is in the form of an ice blade having a blade 36 and a support housing 34, typically formed of a molded plastic. Although the support housing 34 may be integrally formed with an attachment plate 132, as described in another embodiment hereafter, in this embodiment, the support housing 34 is formed with toe and heel mounting flanges 134 and 136, respectively, which extend outward from the main body of the support housing 34. Apertures are formed in the flanges 134 and 136 and are aligned with correspondingly formed apertures formed in the attachment plate 132 to receive suitable fasteners 138, such as Allen head cap screws. It should be noted that the arrangement of the apertures correspond to a conventional international mounting hole pattern used in professional hockey skates. The fasteners 138 provide secure, yet releasable engagement of the attachment 130 to the attachment plate 132.

Figure 15:
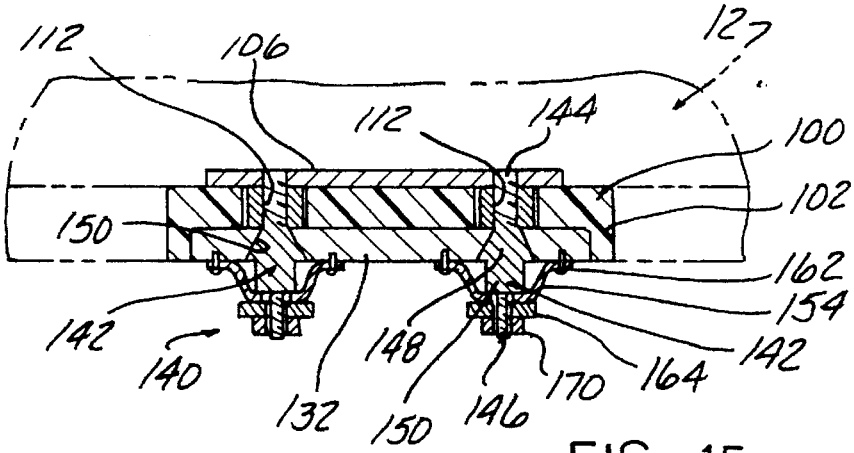
FIG. 15 is a cross sectional view generally taken along line 15—15 in FIG. 9.

Fastener means denoted generally by reference number 140 is mounted on the attachment plate 132 and releasably engage the fastener receiving means 112 in the adapter plate 100. Preferably two fastener means 140 are mounted substantially centrally between the toe and heel of the attachment plate 132 and are laterally spaced apart as shown in FIG. 15. As shown in FIGS. 9 and 10, and in greater detail in FIGS. 14 and 15, each fastener means 140 is formed of a shaft member 142 having opposed first and second threaded ends 144 and 146, respectively. An enlarged frustoconical shaped surface 148 is formed on the shaft 142 intermediate the first and second ends 144 and 146. A generally cylindrical shaft portion 150 is located between one end of the conical surface 148 and the second end 146.

The first threaded end 144 of the shaft 142 threadingly engages the fastener receiving means 112 and the apertures in the adapter plate 100 as shown in FIG. 15. During such mounting, the frustoconical surface 148 engages a complimentary formed conical bore 150 formed in the attachment plate 132. The use of mating conical surfaces provides secure attachment of the attachment plate 132 to the adapter plate 110 and minimizes any lateral and longitudinal movement of the attachment plate 132 relative to the adapter plate 110.

Each fastener means 140 also include a mount 152 having a depending, cup-shaped central portion 154 with a central aperture 156 formed therethrough. A pair of oppositely extending mounting flanges 158 extend from the cup-shaped portion 156 and each has an aperture 160 formed therein for receiving a suitable mounting fastener 162 to attach the mount 152 to the attachment plate 132.

In use, the mount 152 is affixed to the attachment plate 132 as shown in FIG. 15 by means of the fasteners 162. In this mounting position, the shaft 142 is held captive within the mount 152 yet is capable of a slight amount of movement relative to the attachment plate 132.

A user engagable member 164 generally in the form of a planar disk having a central aperture 166 and a serrated peripheral edge 168 is mounted on the second end 146 of the shaft 142 and provides a suitable user engagable surface for threadingly engaging the shaft 142 with the fastener receiving means 112 in the adapter plate 110 as well as enabling release of the attachment plate 132 from the adapter 110. This eliminates the need for a separate tool to attach and detach the attachment 130 to and from the adapter plate 110. Alternately, a nut 170 may be mounted about the exterior end of the second 146 of the shaft 142 adjacent to the disc 164 to permit the use of wrench to provide secure tightening or release of the fastener 140 to the adapter plate 110.

Figure 16:
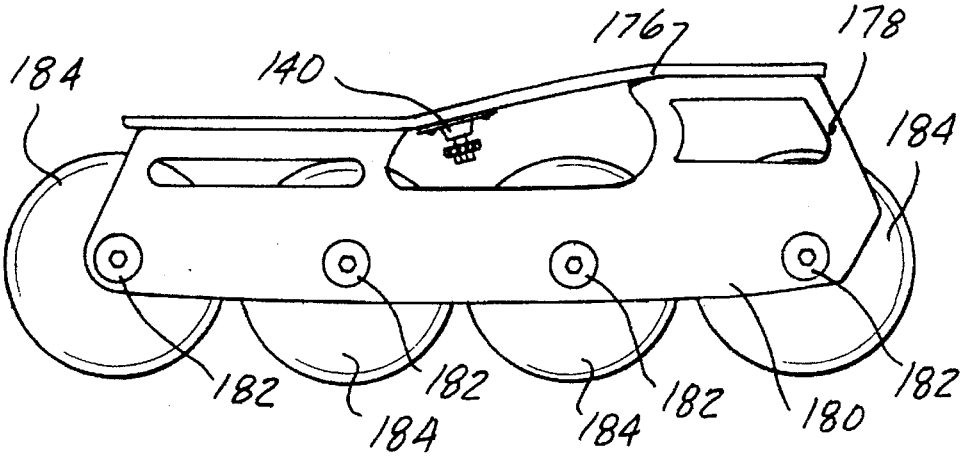
FIG. 16 is a side elevational view of a in-line roller assembly attachment mountable in the adapter plate shown in FIG. 9.

FIG. 16 depicts another embodiment of the present invention in which an attachment plate 176, substantially identical to the attachment plate 132 described above and shown in FIG. 15, has a integrally molded in-line housing 178 extending from one surface thereof. One or more fasteners 140 are mounted on the attachment plate 176 in the same manner as described above and shown in FIG. 15.

The housing 178 includes a pair of spaced side legs which are integrally joined to the attachment plate 176 at an upper end. The opposite ends of the support legs 180 are spaced apart and receive a plurality of axles 182, each supporting a roller 184, as is conventional in the construction of in-line roller skates. The attachment and detachment of the housing 178 and the attachment plate 176 to the adapter plate 110 is the same as that described above for the other embodiments of the present invention.

The attachment plate 132 may also have a shoe sole, similar to sole 72 shown in FIG. 7 fixedly attached to or integrally molded thereto. Additional attachments, such as various skate blades including speed skate blades and figure skate blades, as well as snow shoes, ice claws, etc., may also be mounted on or integrally molded to one of the attachment plates described above.

Figure 17:
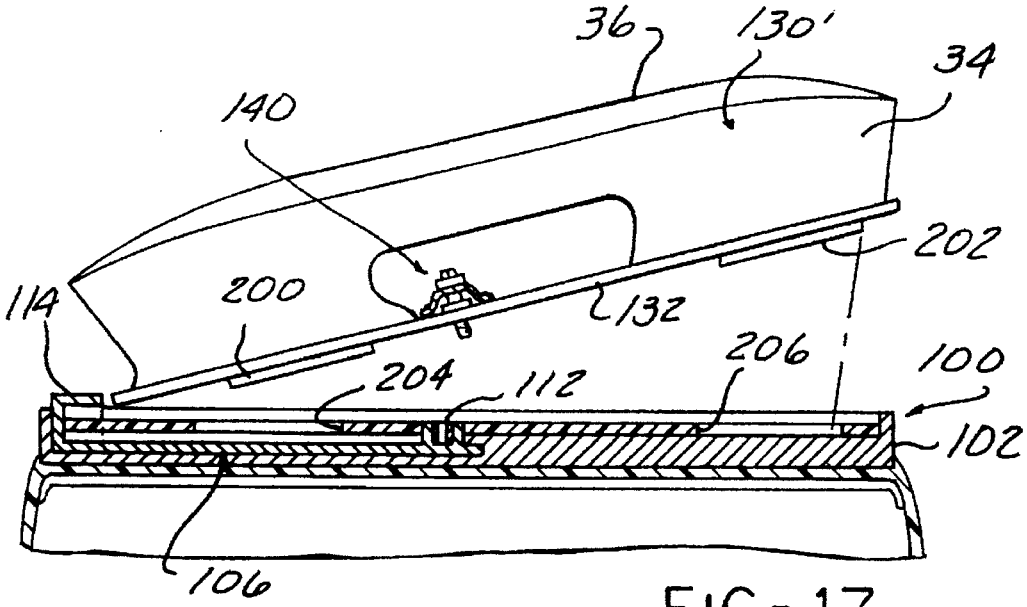
FIG. 17 is an exploded, partially cross sectioned view of another embodiment of the present invention showing the interlocking support ribs and complimentary rib engaging apertures.

Refer now to FIGS. 17 and 18, another embodiment of the present invention is depicted which includes unique lateral support means. Generally, the lateral support means is mounted on one of the adapter plate 100 or the attachment plate 132 of the convertible skate of the present invention. In addition, lateral support engaging means is mounted on the other adapter plate 100 and the attachment plate 132 for securely receiving the lateral support means when the attachment 130' is mounted in the adapter plate 100.

In a preferred embodiment, the lateral support means is in the form of two pairs of spaced projections or ribs 200 and 202 which are formed on and extend outward from the attachment plate 132. Each pair of ribs 200 and 202 includes two ribs which are disposed on opposite sides of the longitudinal center line of the attachment plate 132 and the underlying use element, such as the ice blade 36 or of rollers of an in-line roller skate assembly. Further, the pair of ribs 200 are disposed at the toe portion of the skate; which the pair of ribs 202 are disposed at the heel section of the skate.

Figure 19:
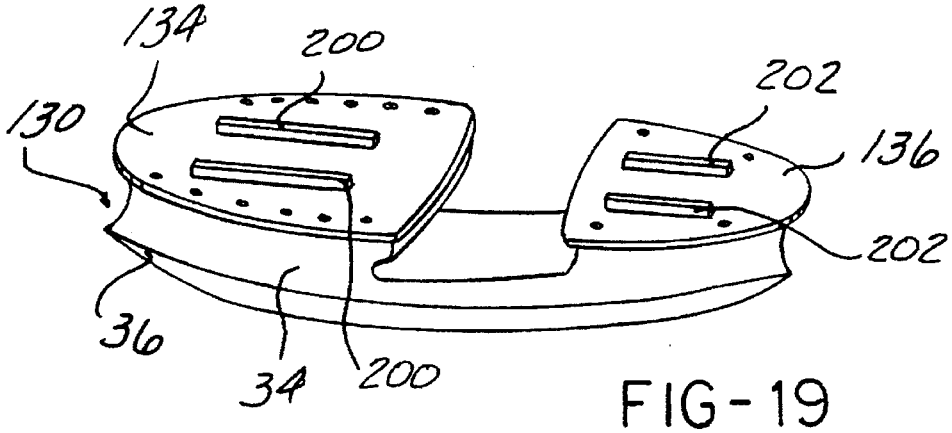
FIG. 19 is a perspective view of an ice blade attachment with lateral support ribs for use with a conventional ice skate boot.

As shown more clearly in FIG. 19, the ribs 200 and 202 have a generally rectangular cross section; although other shapes, such as any polygonal shape, or arcuate shaped elements may also be employed.

In addition, in the situation where the attachment plate 132 is formed of a metallic material, the ribs 200 and 202 may also be formed of a suitable metal and secured in any of a number of suitable methods, such as welding, etc., to the attachment plate 132. If the attachment plate 132 is formed of a plastic, the ribs 200 and 202 may be integrally molded as a unitary, one piece part of the attachment plate 132.

Further, although FIG. 17 depicts the lateral support ribs 200 and 202 as used on an ice blade assembly 130', it will be understood that such lateral support ribs 200 and 202 may also be employed on an in-line roller assembly 178 shown in FIG. 16 and described above.

Although two pairs of spaced ribs 200 and 202 are described as forming the lateral support means of the present invention, it will be understood that other support rib configurations may also be employed within the scope of the present invention. For example, a single elongated rib may extend along the longitudinal center line of the attachment plate 132. In addition, a single pair of ribs in which each rib is formed as a single elongated rib extending along the peripheral edge of the adapter plate 132 may also be provided.

As shown in FIGS. 17 and 18, the support engaging means is preferably in the form of apertures 204 and 206 which have a complimentary shape to the ribs 200 and 202. Thus, a pair of ribs 204 are disposed at the toe section of the adapter plate 100 and a second pair of ribs 206 are formed at the heel portion of the adapter plate 100. The pairs of apertures 204 and 206 are preferably in the form of elongated slots which extend at least partially or even completely through the adapter plate 100. The apertures 204 and 206 are sized to snugly, but releasably receive the ribs 200 and 202 when the attachment plate 132 is mounted in the adapter plate 100.

It will be understood that although the ribs 200 and 202 have been described and illustrated as being mounted on the attachment plate 132 and the complementary shaped slots 204 and 206 formed in the adapter plate 100, an opposite mounting position in which the ribs 200 and 202 are formed on and extend outward from the central portion 104 of the adapter plate 100 and engage complimentary shaped apertures 204 and 206 formed in the attachment plate 132 is also possible according to the present invention.

FIG. 19 depicts the use of the lateral support ribs 200 and 202 on a conventional ice blade attachment 130. The attachment 130, as described above, is affixed to a conventional skate shoe sole by means of fasteners, such as rivets, not shown, which extend through apertures in the toe and heel plates 134 and 136 of the attachment 130 into correspondingly positioned apertures in the skate shoe sole. In this arrangement, the pairs of ribs 200 and 202 extend outward from the toe and heel portions 134 and 136, respectively, and engage complementarily shaped apertures, such as elongated slots, formed in the shoe sole. Contrary wise, the pairs of ribs 200 and 202 may be mounted or formed on and extend outward from the shoe sole to engage complementarily shaped apertures formed in the toe and heel portions 134 and 136 of the skate attachment 130.

The use of the pairs of ribs 200 and 202 and the complementarily shaped apertures 204 and 206 on the skate shoe sole and use attachments, according to the present invention, uniquely isolates high torque forces generated during normal use of a skate from the rivets or other fasteners normally used to mount the use attachment on the shoe sole. Since the fasteners are isolated from such torque forces, potential damage to or breakage of the fasteners is minimized thereby prolonging the useful life of the fasteners with minimal repair time.

In summary, the lateral support ribs of the present invention uniquely isolate lateral torque force from the fasteners used to attach an ice blade or in-line roller assembly to a skate boot. The ribs and the complementary apertures which engage the ribs are formed on the boot sole and the blade or roller assembly housing. The support ribs are also useable in a convertible skate assembly.

What is claimed is:

1. A skate comprising:

a shoe having a sole, the sole having a central portion and a peripheral edge;

an attachment supporting a use element, the attachment affixed to the sole by at least one fastener extendable through the peripheral edge of the attachment into the sole, the attachment having a central portion and a peripheral edge;

at least one lateral support member formed on the central portion of one of the shoe sole and the attachment and spaced inward from the peripheral edge thereof; and at least one lateral support engaging aperture formed on the other of the sole and the attachment and complementary to the lateral support member for securely engaging the lateral support member.

2. The skate of claim 1 wherein:

the lateral support member is at least one outwardly extending projection.

3. The skate of claim 2 wherein:

the projection is formed as an elongated rib and the aperture is formed as an elongated slot complementarily shaped to receive the rib.

4. The skate of claim 1 wherein:

the at least one lateral support member includes at least one pair of spaced ribs; and the at least one lateral support engaging aperture includes at least one pair of apertures complementary to the pair of ribs.

5. The skate of claim 4 wherein:

the lateral support member includes two pairs of ribs; and the lateral support engaging aperture includes two pairs of apertures.

6. The skate of claim 5 wherein:

one pair of ribs is disposed adjacent a toe end of the skate and another pair of ribs is disposed adjacent a heel end of the skate.

7. The skate of claim 4 wherein:

the ribs of each pair of ribs are disposed on opposite sides of a longitudinal center line of the use element mounted in the attachment.

8. The skate of claim 4 wherein the at least one fastener extendable through the attachment into the sole comprises:

a plurality of fasteners disposed along the peripheral edge of the attachment; and the pair of ribs are disposed inward of the plurality of fasteners.

9. The skate of claim 1 wherein:

the lateral support member is formed on the shoe sole; and the lateral support engaging aperture is formed on the attachment.

10. The skate of claim 1 wherein:

the lateral support member is formed on the attachment; and the lateral support engaging aperture is formed on the shoe sole.

11. A skate comprising:

a shoe body;

an adapter plate fixedly carried on the shoe body, the adapter plate having a central portion and a peripheral sidewall depending from the central portion;

an attachment having a central portion and a peripheral edge releasably mountable in the adapter plate in registry with the central portion and the depending sidewall of the adapter plate, respectively;

at least one fastener connecting the attachment to the adapter plate in a non-movable, fixed connection;

at least one lateral support elongated rib extending outwardly from the central portion of one of the adapter plate and the attachment and spaced inward from one of the peripheral edge and the peripheral sidewall; and at least one lateral support engaging elongated slot formed on the other of the adapter plate and the attachment and complementarily shaped to the rib for securely engaging the lateral support member.

12. A skate comprising:

a shoe body;

an adapter plate fixedly carried on the shoe body, the adapter plate having a central portion and a peripheral sidewall depending from the central portion;

an attachment having a central portion and a peripheral edge releasably mountable in the adapter plate in registry with the central portion and the depending sidewall of the adapter plate, respectively;

at least one fastener connecting the attachment to the adapter plate in a non-movable, fixed connection;

at least one pair of spaced lateral support ribs formed on the central portion of one of the adapter plate and the attachment and spaced inward from one of the peripheral edge and the peripheral sidewall; and at least one pair of lateral support apertures complementary to the ribs and formed on the other of the adapter plate and the attachment and complementary to the lateral support member for securely engaging the lateral support member.

13. The skate of claim 12 wherein:

the ribs of each pair of ribs are disposed on opposite sides of a longitudinal center line of the attachment.

14. The skate of claim 13 wherein:

the lateral support member includes two pairs of ribs; and the lateral support engaging aperture includes two pairs of apertures.

15. The skate of claim 14 wherein:

one pair of ribs is disposed adjacent a toe end of the skate and another pair of ribs is disposed adjacent a heel end of the skate.

16. The skate of claim 12 wherein the at least one fastener extendable through the attachment into the sole comprises:

a plurality of fasteners disposed along the peripheral edge of the attachment; and the pair of ribs are disposed inward of the plurality of fasteners.

17. A skate comprising:

a shoe body;

an adapter plate fixedly carried on the shoe body, the adapter plate having a central portion and a peripheral sidewall depending from the central portion;

an attachment having a central portion and a peripheral edge releasably mountable in the adapter plate in registry with the central portion and the depending sidewall of the adapter plate, respectively;

at least one fastener connecting the attachment to the adapter plate in a non-movable, fixed connection;

at least one lateral support member formed on the central portion of the attachment and spaced inward from one of the peripheral edge and the peripheral sidewall; and at least one lateral support engaging aperture formed on the adapter plate and complementary to the lateral support member for securely engaging the lateral support member.

* * * * *